US010435926B2

(12) United States Patent
Brown et al.

(10) Patent No.: US 10,435,926 B2
(45) Date of Patent: Oct. 8, 2019

(54) RETRACTABLE HANDLE ARRANGEMENT

(71) Applicant: JAGUAR LAND ROVER LIMITED, Whitley, Coventry, Warwickshire (GB)

(72) Inventors: Olly Brown, Coventry (GB); Peter Lumsden, Wolston (GB); Bruno Gaouyer, Leamington Spa (GB); Sean Edwards, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 0 days.

(21) Appl. No.: 15/561,477

(22) PCT Filed: Mar. 24, 2016

(86) PCT No.: PCT/EP2016/056657
§ 371 (c)(1),
(2) Date: Sep. 25, 2017

(87) PCT Pub. No.: WO2016/151116
PCT Pub. Date: Sep. 29, 2016

(65) Prior Publication Data

US 2018/0058114 A1 Mar. 1, 2018

(30) Foreign Application Priority Data

Mar. 25, 2015 (GB) ..... 1505038.8

(51) Int. Cl.
*E06B 3/00* (2006.01)
*E05B 85/10* (2014.01)
(Continued)

(52) U.S. Cl.
CPC ..... *E05B 85/107* (2013.01); *E05B 81/90* (2013.01); *E05B 85/103* (2013.01); *E05B 85/16* (2013.01);
(Continued)

(58) Field of Classification Search
CPC ..... E05B 85/107; E05B 85/16; E05B 85/103; E05B 85/06; E05B 85/76; E05B 85/08;
(Continued)

(56) References Cited

U.S. PATENT DOCUMENTS

2011/0148575 A1* 6/2011 Sobecki ..... E05B 85/103 340/5.64
2013/0241215 A1 9/2013 Halliwell et al.
(Continued)

FOREIGN PATENT DOCUMENTS

DE 102006048371 A1 4/2008
DE 102008019335 A1 10/2008
(Continued)

OTHER PUBLICATIONS

Combined Search and Examination Report for application No. GB1505038.8, dated Aug. 7, 2015, 9 pages.
(Continued)

*Primary Examiner* — Jerry E Redman
(74) *Attorney, Agent, or Firm* — Reising Ethington P.C.

(57) ABSTRACT

A retractable handle arrangement comprising a handle movable between stowed, deployed and operative states, and including first and second deployment means both of which are operable independently to move the handle from the stowed state to the deployed state. The first deployment mechanism is electrically actuated and the second deployment mechanism is manually actuated. The second deployment mechanism is a two-state latching mechanism, which may be a so-called 'push-push' mechanism, operable to deploy the handle when triggered by a small inward movement.

11 Claims, 3 Drawing Sheets

(51) Int. Cl.

| | |
|---|---|
| ***E05B 81/90*** | (2014.01) |
| ***E05B 85/16*** | (2014.01) |
| *E05B 81/06* | (2014.01) |
| *E05B 81/08* | (2014.01) |
| *E05B 81/76* | (2014.01) |

(52) U.S. Cl.
CPC ..... *E05B 81/06* (2013.01); *E05B 81/08* (2013.01); *E05B 81/76* (2013.01); *E05Y 2600/12* (2013.01); *E05Y 2600/13* (2013.01); *E05Y 2600/41* (2013.01); *E05Y 2600/46* (2013.01); *E05Y 2900/531* (2013.01)

(58) Field of Classification Search
CPC ..... E05B 81/90; E05B 81/76; E05Y 2600/41; E05Y 2600/46; E05Y 2600/12; E05Y 2600/13; E05Y 2900/531; E05F 15/63; E05F 1/1016
USPC ..... 49/503
See application file for complete search history.

(56) References Cited

U.S. PATENT DOCUMENTS

| | | | | |
|---|---|---|---|---|
| 2014/0000165 | A1* | 1/2014 | Patel | E05B 81/76 49/31 |
| 2014/0000167 | A1* | 1/2014 | Patel | E05B 81/34 49/32 |
| 2014/0173985 | A1 | 6/2014 | Alsadah | |
| 2015/0233153 | A1* | 8/2015 | Smart | E05B 85/103 70/237 |
| 2015/0233154 | A1* | 8/2015 | Smart | E05B 85/103 70/237 |
| 2015/0315826 | A1* | 11/2015 | Lang | E05B 85/103 49/503 |
| 2016/0273247 | A1* | 9/2016 | Fujiwara | E05B 81/06 |
| 2017/0234040 | A1* | 8/2017 | Bartels | B60L 11/1861 70/258 |
| 2018/0058113 | A1* | 3/2018 | Han | E05B 79/20 |
| 2018/0106082 | A1* | 4/2018 | Brown | E05B 85/107 |
| 2018/0148957 | A1* | 5/2018 | Och | E05B 81/76 |
| 2018/0163442 | A1* | 6/2018 | Soonthornwinate | E05B 77/12 |
| 2018/0171686 | A1* | 6/2018 | Couto Maquieira | E05B 81/16 |
| 2018/0216373 | A1* | 8/2018 | Torkowski | E05B 79/06 |

FOREIGN PATENT DOCUMENTS

| | | | | |
|---|---|---|---|---|
| DE | 202017103702 | U1 * | 7/2017 | B60J 5/04 |
| GB | 2345437 | A | 7/2000 | |
| GB | 2492231 | A | 12/2012 | |
| GB | 2506350 | A | 4/2014 | |
| GB | 2536672 | A * | 9/2016 | E05B 81/90 |
| WO | WO-2012100803 | A1 * | 8/2012 | E05B 85/107 |
| WO | WO2012175647 | A2 | 12/2012 | |
| WO | WO2015073119 | A1 | 5/2015 | |
| WO | WO2015074020 | A1 | 5/2015 | |

OTHER PUBLICATIONS

International Search Report for International Application No. PCT/EP2016/056657, dated Jun. 29, 2017, 6 pages.
Written Opinion for International Application No. PCT/EP2016/056657, dated Jun. 29, 2017, 6 pages.
British Examination Report for application No. GB1505038.8, dated Aug. 1, 2017, 4 pages.

* cited by examiner

RETRACTABLE HANDLE ARRANGEMENT

TECHNICAL FIELD

The present disclosure relates to a retractable handle arrangement for a door or other type of closure. Aspects of the disclosure relate to a handle arrangement, a body component and to a vehicle.

BACKGROUND

The invention will be described in the context of a car door, but it could also be used with other closures such as trunks/tailgates, or with other types of vehicles such as boats or aircraft. In a broad sense, the invention may also be used in non-vehicle applications.

A relatively recent development in the design of vehicle door handles is the retractable handle in which a flush-mounted handle is retractably mounted to the vehicle door such that the handle is flush with an outer door skin of the vehicle. This means that the handle can move between two states: a stowed or retracted state in which the handle is flush-mounted and a deployed or extended state in which the handle protrudes from the surrounding door surface so that it may be grasped by a user.

Once the handle is in the deployed state, it can be pulled, usually against a spring bias, to move the handle towards a third, operative, state to unlatch the door. In moving to the operative state the handle may unlatch the door mechanically, for example by acting on a Bowden cable coupled to the door latch, or electrically by acting on an electrical switch coupled to the latch. Examples of such a vehicle door handle are described in the applicant's co-pending US patent application no. US2013/0241215 A1 and published PCT application no. WO2012/175647.

In the context of retractable door handles, the handles themselves may be movable between the stowed and deployed states mechanically or by electrical means. For example, in a handle arrangement used in some cars, a flush-mounted handle comprises a bar-like handle pivotally attached near one of its ends to a door. In the stowed state the handle lies flush with the door skin and, in the deployed state, the major portion of the handle pivots away from the door skin so that a user can grasp the handle and pull it further into the operative state to unlatch the door. A user moves the handle between the stowed and deployed states simply by pressing the front end of the handle against a spring bias so that the rear portion pivots outwardly. Although this scheme provides a relatively simple mechanical action, it is rather unintuitive to use and requires a two-handed operation which is undesirable.

In contrast, an electrically-actuated scheme is implemented in some other cars. Here, a flush-mounted strap-type handle is actuated electrically between a stowed state in which the outer surface of the handle is flush with the door skin and a deployed state in which the outer surface of the handle is spaced from the door skin and so reveals a grab-loop which can be grasped by a user. The handle is moved from the stowed to the deployed state by means of a sensing system which senses the presence of a person next to the door or about to grab the handle. The sensing system may also be configured to command the handle into a deployed state in response to a deployment signal transmitted by a suitable control device, e.g. a remote key fob of the vehicle.

Since the handle is activated automatically and deploys into a deployed state without mechanical input from a user, it is intuitive to use and offers a characteristic 'surprise and delight' feature of the vehicle. However, when a handle is powered electrically, there is a potential problem when electrical power is unavailable.

It is against this background that the invention has been devised.

SUMMARY OF THE INVENTION

In an aspect of the invention, the invention resides in a retractable handle arrangement comprising a handle movable between stowed, deployed and operative states, and including first and second deployment mechanisms both of which are operable independently to move the handle from the stowed state to the deployed state. The first deployment mechanism is electrically actuated and the second deployment mechanism is manually actuated. The second deployment mechanism is a two-state latching mechanism, which may be a so-called 'push-push' mechanism, in the sense that the mechanism is pushed to unlatch it, and a second push re-latches it e.g. by a small inboard movement of the handle where the door handle may recess below the surrounding surface of the door.

An advantage of the invention is that if the first deployment means fails, the second deployment means is still able to deploy the handle so that the user can open the door. The handle arrangement is particularly beneficial in circumstances where the electrically operated deployment mechanism fails, and the user is still able to access the handle to, e.g. open the door of the vehicle.

The latch mechanism may have a latched state corresponding to a stowed position of the handle, although the handle can also be deployed by the first deployment mechanism with the second deployment mechanism in this state.

The invention may also be expressed as a retractable door handle arrangement comprising a handle that is movable between a stowed state and a deployed state by an electrical drive mechanism, wherein the handle is also movable into the deployed state from the stowed state by an emergency deployment mechanism that is separate from the electrical drive mechanism. The emergency deployment mechanism is a manually actuated two-state latching mechanism.

Features and/or optional features of the previous aspect of the invention may be combined with this aspect of the invention.

The invention can also be expressed as a body component for a vehicle comprising a panel having an outer surface that defines an aperture for receiving the handle of the retractable handle arrangement of any one of the inventive concepts described above. The aperture receives the handle as a close fit and the outer surface of the handle is shaped to match and to lie flush with the outer surface of the panel when the handle is in a stowed position.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION OF EMBODIMENTS

A detailed description of specific embodiments of a door handle arrangement according to the invention will now be provided. It will be understood that the embodiments described are merely examples of the way in which certain aspects of the invention may be implemented and do not represent an exhaustive list of all the ways the invention may be embodied. The Figures are not necessarily to scale and some features may be minimise, exaggerated, simplified or omitted for reasons of clarity and to show certain components more clearly. Well-known components, structures, techniques materials or methods/processes are not necessarily described in great detail in order to avoid obscuring the inventive concept. It will be apparent to the skilled person that the invention may be put into effect without the specific details or that variations may be made to those specific features in question.

Figure 1:
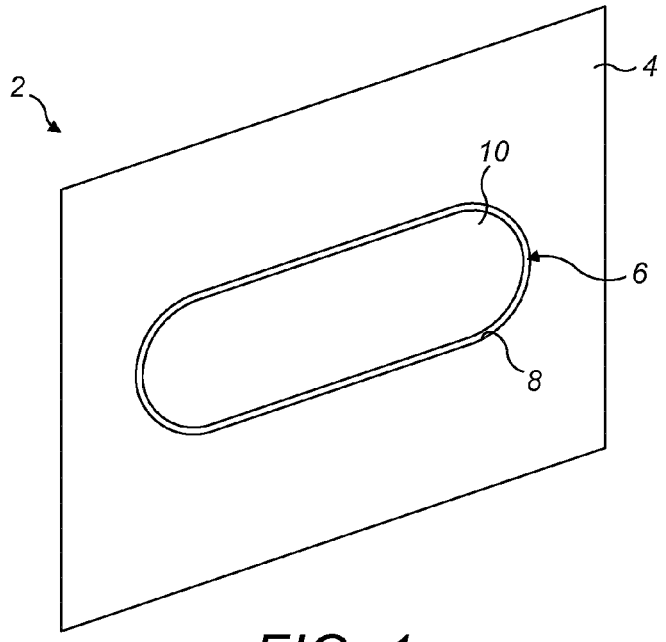
FIG. 1 is a perspective view of a vehicle door panel equipped with a retractable door handle arrangement being shown in a stowed state.

Referring firstly to FIG. 1, a door handle arrangement 2 of an embodiment of the invention is retractable with respect to a door of a vehicle. An outer surface or 'door skin' 4 is shown here as representing the door, but can in principle be any body component that requires a handle, for example a tailgate. The door handle arrangement includes a handle 6 that is substantially flush-mounted with respect to the door skin 4 when the handle is in a stowed state, as shown here. The handle 6 is operable to transition from the stowed state to a deployed state in which it protrudes from the door skin 4 so that it can be grasped by a user, as will be described.

The door skin 4 is penetrated by a horizontally-extending slot 8 that receives the handle 6 in a close fit. The outer surface 10 of the handle 6 is shaped to match that of the slot 8 and lies flush with the surrounding surface of the door skin 4 when the handle is stowed as in FIG. 1. The shape of the slot 8 and the outer surface 10 of the handle 6 is chosen largely for aesthetic reasons and is immaterial in terms of function.

Although in FIG. 1 only the outer surface 10 of the handle 6 can be seen, the remaining Figures show the handle arrangement 2 in more detail.

The retractable handle arrangement 2 comprises a drive means/arrangement 12 which is operable to move the handle 6 between the stowed state and a deployed state as will be described in detail. The drive arrangement 12 is electrically operated and is shown here largely in schematic form as comprising an electrical drive unit 14, such as a motor or solenoid, that is operable to drive a spindle 16 on which the handle 6 is mounted. It is envisaged that the drive unit 14 may act on the spindle 16 through a suitable worm gear or rack and pinion (not shown) in order to provide fine positioning control of the spindle 16 and, thus, of the handle 6. It should be noted that the drive arrangement 12 depicted here represents one way in which the handle 6 may be moved angularly between its stowed and deployed states and that other ways would be apparent to the skilled person, for example the electrically-driven handle deployment mechanisms as described in the applicant's co-pending patent applications US2013/0241215 and WO2012/175647, the contents of which are incorporated herein by reference.

In more detail, the handle 6 is an elongate member having first and second ends 20, 22. A pivot 24 is disposed at the first end 22 of the handle 6 and cooperates with the spindle 16 of the drive arrangement 12 in order to allow the handle 10 to move angularly with respect to the slot 8 between stowed and deployed states. A strap-type handle loop 26 defined at the second end 20 of the handle is linked to the pivot by an arm 27.

Figure 3A:
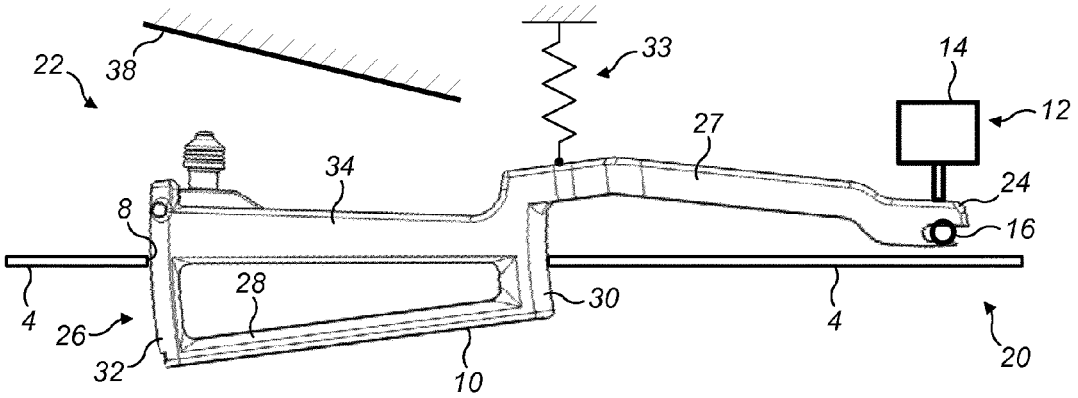
FIG. 3*a* is a view of the handle arrangement shown in FIG. 2 but here it is shown in a deployed state.

The handle loop 26 provides a handgrip 28 that defines the outer surface 10, with end pieces 30, 32 at opposed ends spacing the handgrip 28 from an inner member 34 that is shaped like the handgrip 28 so as to fill the slot 8 when the handle is deployed, as shown in FIG. 3*a*.

The end pieces 30,32 are generally parallel to each other and are slightly curved in plan view. Together, the handgrip 28, end pieces 30, 32 and the inner member 34 form an approximate truncated wedge shape, such a shape again being determined mainly for aesthetic reasons.

Figure 2:
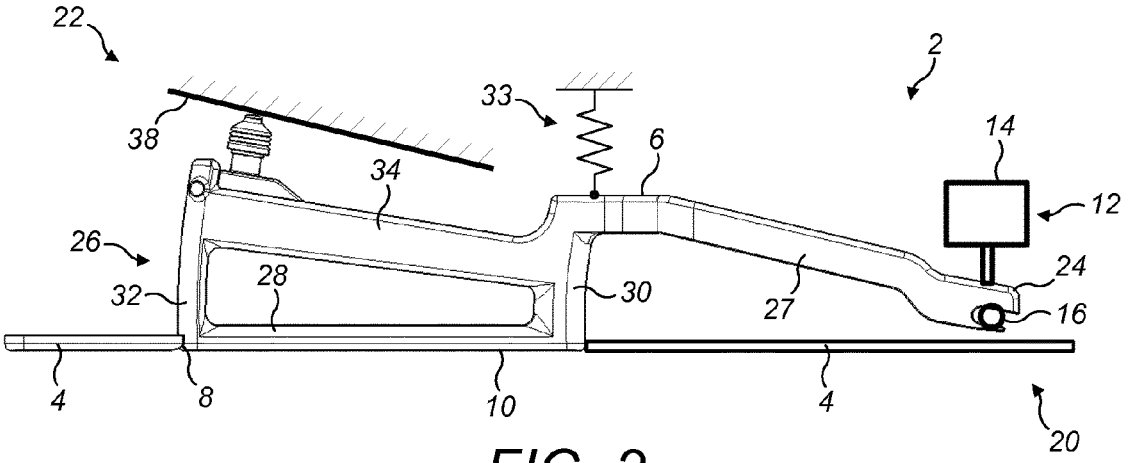
FIG. 2 is a view from above of the handle arrangement in FIG. 1 installed within the door panel.

Whereas FIG. 2 shows the handle 6 in the stowed state, FIG. 3*a* shows the handle as deployed, in which the handgrip 28 has popped out of the slot 8 so as to stand proud of the surrounding door skin 4. This reveals the handle loop 26 so that the user can grasp the handgrip 28 and move the handle 6 angularly against a bias spring 33 to drive the handle arrangement 2 into an operative state so as to unlatch the door.

When grasping the handgrip 28 to pull the handle 4, the user's fingers and possibly also the thumb can extend between the handgrip 28 and the inner member 34. Since the loop 26 is open from the top and bottom, this allows the user to approach the handle 6 with an overhand or an underhand grip, whichever is more comfortable.

The handle 6 may be driven by the drive arrangement 12 from its stowed state to its deployed state in response to various events. For example, this movement may be in response to an unlocking signal from a key authorised to unlock the vehicle or from a proximity sensor that detects the presence of an authorised key in the immediate vicinity of the vehicle. Conversely, the handle 6 may be driven from the deployed to the stowed state in response to a locking signal from a key authorised to lock the vehicle or from a proximity sensor that determines that the authorised key has left the immediate vicinity of the vehicle. Alternatively, the handle 4 may toggle between the stowed and deployed states in response to different user actions, for example the user may press and lock/unlock switch (not shown) somewhere in the vehicle door.

Figure 3B:
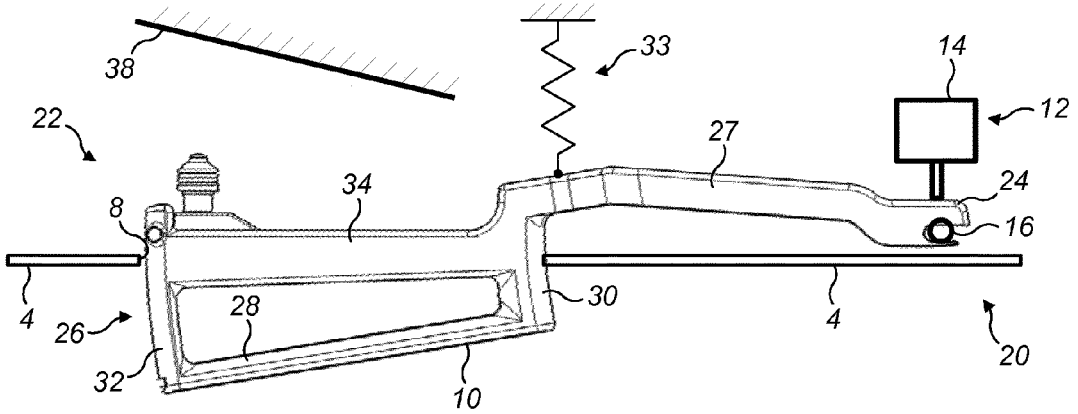
FIG. 3*b* is a view of the handle arrangement like that in FIG. 3*a* but shown in an operative state.

Once in the deployed state, the handle 6 can then be pulled to open the door, which involves the user pivoting the handle 6 further outwardly against spring bias into the operative state, as shown in FIG. 3*b*, which causes the door to be unlatched thereby allowing it to open.

In moving from the deployed to the operative state, the handle 6 may unlatch the door mechanically or electrically, such means being generally known in the art and so are not disclosed here in detail. For example, to unlatch the door mechanically, the handle 6 may be provided with a suitable linkage cooperable with a Bowden cable that acts on the door latch (not shown) in a well-known manner. Alternatively, the door handle 6 may be configured to cooperate with a limit switch such that in the operative state the limit switch is triggered so as to send a door opening signal to a body control module (BCM) of the vehicle which then commands the relevant door to be unlatched. Such a mechanism is also known to the skilled person and so is not described in detail here.

The discussion above has focussed on the movement of the handle 6 as it transitions from its stowed state, in which it lies substantially flush with the door skin 4, to the deployed state, in which it is driven by the drive unit 14 to protrude from the door, whereby the handle 6 is then able to be moved through a further range of movement into the operative state so as to unlatch the door. Such a handle arrangement 2 has several advantages, for example its low profile when stowed which helps to meet legislation governing exterior projections on vehicles and also promotes clean airflow over the door. However, the fact that the handle arrangement 2 is electrically driven may be a problem in a power-loss condition, for example if the battery of the vehicle discharges to an extent that it can no longer power functions like door opening. One possibility may be to provide a battery back-up system in which an auxiliary battery supplies an emergency power source in the unlikely event of the main vehicle battery being depleted. However, providing a back-up power source in this way increases the complexity of the door opening system, presents packaging challenges, and has an associated cost and weight penalty thereby making it an unattractive solution.

To this end, the handle arrangement 2 of this embodiment of the invention provides an elegant 'back-up' or 'secondary' handle deployment means comprising a manually actuated mechanism that transitions the handle from its stowed state to the deployed state and which is separate to and operates independently of the drive arrangement 12 as the primary deployment means.

In the illustrated embodiment, the secondary deployment means comprises a latch mechanism 36 that is operable between two states: a latched or compressed state, which corresponds to the stowed position of the handle 6 and an unlatched or extended state, which corresponds to the deployed position of the handle 6. However, note that the latch mechanism may also be in the compressed state when the handle 6 is deployed, as will become clear.

The latch mechanism 36 can be operated by a user in circumstances where the drive arrangement 12 is unable to move the handle 6 into the deployed state and therefore provides a mechanical means for a user to deploy the handle from the door where the electrical drive arrangement is unresponsive to deployment commands.

The latch mechanism is located on the inboard side of the inner member 34 and extends away from it so as to be cooperable with a support structure 38 that is provided by the door.

The support structure 38 is shown schematically as a plain surface in the Figures, but it should be noted that this could be any suitable structure or surface against which the latch mechanism 36 can abut or bear against in order to push the handle into the deployed position.

As shown in FIG. 2, the handle 6 is stowed and in this state the latch mechanism 36 is in contact with the support structure 38, although it should be noted that a small gap, envisaged to be in the order of approximately 0.2 to 1.0 mm, between the support structure 38 and the latch mechanism 36 is acceptable, although these dimensions are given only by way of example. During normal operation of the handle 6 between the stowed and deployed states, as driven by the electrical drive arrangement 12, the latch mechanism 36 remains in the compressed state, as is shown by FIGS. 3*a* and 3*b*. In FIG. 3*b*, therefore, the latch mechanism 36 is still in the compressed state but has moved away from the support structure 38 with the handle 6.

Figure 4A:
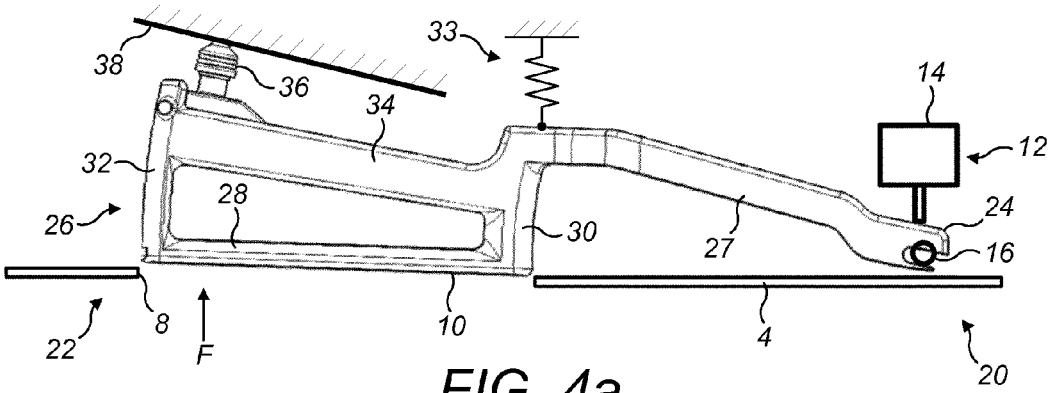
FIG. 4*a* is a view similar to that in FIG. 2, but in which the handle is shown transitioning into an 'emergency release' state.
Figure 4B:
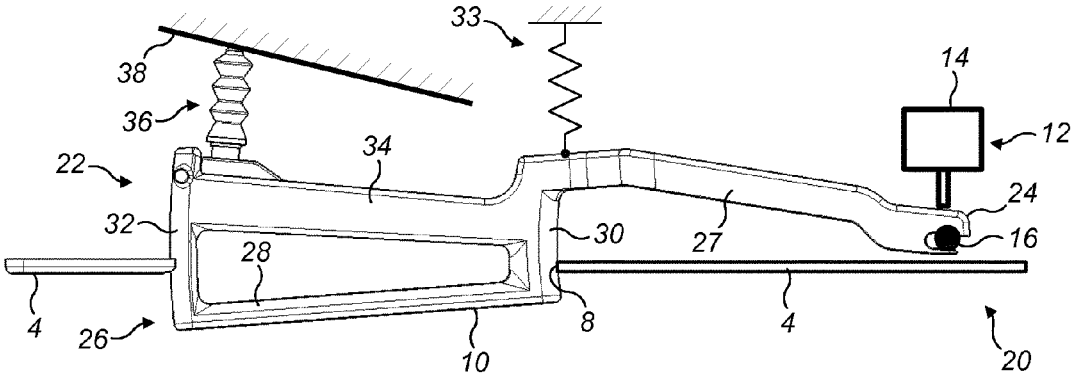
FIG. 4*b* shows the handle arrangement of FIG. 4*a* partially deployed following activation into the emergency release state.

In an emergency or backup scenario, however, as shown in FIGS. 4*a* and 4*b*, the latch mechanism 36 is activated or triggered by pushing the handle 6 inward so that the outer surface 10 of the handle 6 recesses slightly from the door skin 4 so that it is under-flush. This inward push of the handle 6, as indicated by arrow 'F' in FIG. 4*a*, activates or releases the latch mechanism 36 that allows it to transition into its extended state, as shown in FIG. 4*b*. The latch mechanism 36 may therefore also be considered to be a 'push-push' or 'push to release' mechanism, in the sense that it is pushed in order for it to be unlatched, and then pushed for a second time in order to re-latch it.

In transitioning between the compressed and extended states, the latch mechanism 36 bears against the support structure 38 and exerts a force on the handle 6 to urge it from the slot 8 and into the deployed position. Here, it will be noticed that the handle 6 does not protrude out of the slot 8 as far as the deployed position illustrated in FIG. 3*a*. This is due to the limited maximum travel of the latch mechanism 36, although the travel is sufficient to deploy the handle 6 enough so that a user can grasp the handgrip 28. As such, the terms 'deployed' and 'deployed state' as used herein such be taken to be any position in which the handle is moved beyond or outboard of the door skin 4 so that a user can grasp the handle 6.

Figure 5:
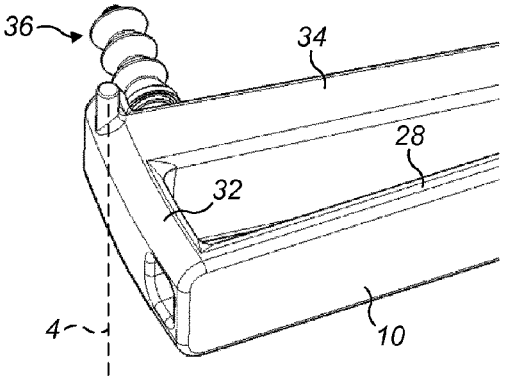
FIG. 5 is a partial perspective view of the handle in FIG. 4*b* being partially deployed.

The handle is also shown in this 'partially deployed' position in FIG. 5 in a perspective view in which only a small portion of the door skin 4 is illustrated.

To reinstate the handle 6 into the stowed state, the user simply follows the reverse of the procedure described above. For instance, the handle 6 is pushed from the deployed position as illustrated in FIG. 4*b* into the under-flush position as illustrated in FIG. 4*a* which re-latches the latch mechanism 36 so that the handle 6 then remains in the stowed state.

The skilled person will appreciate that variations to the specific embodiments discussed above may be made without departing from the inventive concept as defined by the claims.

The invention claimed is:

1. A retractable handle arrangement comprising a handle movable between stowed, deployed and operative states, and including first and second deployment mechanisms both of which are operable independently to move the handle from the stowed state to the deployed state wherein the first deployment mechanism is electrically actuated, and wherein the handle comprises a handle loop and the second deployment mechanism is a manually actuated two-state latching mechanism operable between a compressed state and an extended state;

wherein in transitioning from the compressed state to the extended state, the latching mechanism is arranged to bear against a support structure and exert a force on the handle to urge the handle into the deployed state, and wherein the latching mechanism is located on an inboard side of an inner member of the handle loop and extends away from the inner member so as to be cooperable with the support structure.

2. The handle arrangement of claim 1, wherein the latching mechanism has a latched first state corresponding to a position of the handle when in the stowed state of the handle.

3. The handle arrangement of claim 1, wherein the latching mechanism has an unlatched second state corresponding to a position of the handle when in the deployed state.

4. The handle arrangement of claim 1, wherein the latching mechanism is unlatched by an initial movement of the handle in a direction away from the position of a handle when in the deployed state, whereafter the latching mechanism automatically then pushes the handle towards the deployed state.

5. A body component for a vehicle comprising a door panel having an outer surface that defines an aperture for receiving the handle of the retractable handle arrangement of claim 1, wherein the handle is received within the aperture.

6. The body component according to claim 5, wherein the handle has an outer surface which is shaped to correspond to the aperture.

7. The body component according to claim 5, wherein the outer surface of the handle lies flush with the outer surface of the panel when the handle is in the stowed state.

8. The body component according to claim 5, wherein the latching mechanism of the handle arrangement is unlatched by an initial movement of the handle in a direction away from a position of the handle when in the deployed state, whereafter the latching mechanism automatically then pushes the handle towards the deployed state and wherein said initial movement of the handle comprises moving the door handle to a position in which the handle is recessed below the outer surface of the door panel adjacent the handle.

9. A vehicle including the body component of claim 5.

10. A vehicle including the retractable handle arrangement of claim 1.

11. A retractable handle arrangement comprising a handle that is movable between a stowed state and a deployed state by an electrical drive mechanism, wherein the handle comprises a handle loop and the handle is also movable into the deployed state from the stowed state by an emergency deployment mechanism that is separate from the electrical drive mechanism, wherein the emergency deployment mechanism is a manually actuated two-state latching mechanism operable between a compressed state and an extended state;

wherein in transitioning from the compressed state to the extended state, the latching mechanism is arranged to bear against a support structure and exert a force on the handle to urge the handle into the deployed state, and wherein the latching mechanism is located on an inboard side of an inner member of the handle loop and extends away from the inner member so as to be cooperable with the support structure.

* * * * *